US011583155B2

(12) United States Patent
Lee et al.

(10) Patent No.: US 11,583,155 B2
(45) Date of Patent: Feb. 21, 2023

(54) ROBOT CLEANER

(71) Applicant: LG ELECTRONICS INC., Seoul (KR)

(72) Inventors: Seungjin Lee, Seoul (KR); Hwang Kim, Seoul (KR); Jongho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 296 days.

(21) Appl. No.: 16/997,503

(22) Filed: Aug. 19, 2020

(65) Prior Publication Data

US 2021/0161346 A1 Jun. 3, 2021

(30) Foreign Application Priority Data

Nov. 29, 2019 (KR) ..... 10-2019-0156710

(51) Int. Cl.

| | |
|---|---|
| ***A47L 9/28*** | (2006.01) |
| ***A47L 9/04*** | (2006.01) |
| ***A47L 9/00*** | (2006.01) |

(52) U.S. Cl.

CPC ..... *A47L 9/2847* (2013.01); *A47L 9/009* (2013.01); *A47L 9/0411* (2013.01); *A47L 9/0433* (2013.01); *A47L 9/0455* (2013.01); *A47L 9/2805* (2013.01); *A47L 2201/06* (2013.01)

(58) Field of Classification Search

CPC ..... A47L 9/2847; A47L 9/009; A47L 9/0411; A47L 9/0433; A47L 2201/06

See application file for complete search history.

(56) References Cited

U.S. PATENT DOCUMENTS

2018/0078106 A1* 3/2018 Scholten ..... G01S 17/931

FOREIGN PATENT DOCUMENTS

| | | |
|---|---|---|
| JP | H05-300860 | 11/1993 |
| JP | 3134485 | 2/2001 |
| JP | 2010-035773 | 2/2010 |
| JP | 5243879 | 7/2013 |
| KR | 10-2006-0015082 | 2/2006 |
| KR | 10-2006-0111788 | 10/2006 |
| KR | 10-1420972 | 7/2014 |

(Continued)

OTHER PUBLICATIONS

Korean Office Action dated Dec. 15, 2020 issued in KR Application No. 10-2019-0156710.

(Continued)

*Primary Examiner* — Andrew A Horton

(74) *Attorney, Agent, or Firm* — Ked & Associates, LLP

(57) ABSTRACT

Provided is a robot cleaner including a main body including a suction portion disposed thereon, main wheels for moving the main body, a side brush assembly disposed on the main body and rotating with a rotation shaft perpendicular to a rotation shaft of the main wheels, wherein the side brush assembly includes a housing for forming an exterior of the side brush assembly, a first force transmitter disposed in the housing and rotating by receiving a driving force, a second force transmitter in contact with the first force transmitter to rotate together when the first force transmitter is rotated, and a side brush coupled to the second force transmitter to rotate at the same rotation angle as the second force transmitter.

20 Claims, 8 Drawing Sheets

(56) References Cited

FOREIGN PATENT DOCUMENTS

| | | |
|---|---|---|
| KR | 10-1540304 | 7/2015 |
| TW | 201838578 | 11/2018 |
| TW | 201909827 | 3/2019 |

OTHER PUBLICATIONS

International Search Report and Written Opinion dated Jan. 5, 2021 issued in International Application No. PCT/KR2020/009577.
Taiwanese Office Action dated Aug. 18, 2021 issued in Application No. 109128668 (English translation attached).
Korean Notice of Allowance dated Jan. 3, 2023 issued in Application 10-2021-0046227.

* cited by examiner (a)

(b)

ROBOT CLEANER

CROSS-REFERENCE TO RELATED APPLICATION

This application claims priority under 35 U.S.C. § 119 to Korean Application No. 10-2019-0156710 filed on Nov. 29, 2019, whose entire disclosure is hereby incorporated by reference.

BACKGROUND

1. Field

The present disclosure relates to a robot cleaner, and more particularly, to a robot cleaner that does not cause damage to an obstacle or a side brush even when the obstacle is caught on the side brush during travel.

2. Background

Generally, a vacuum cleaner is an appliance that sucks air containing a foreign substance from outside by driving an air suction apparatus, which is disposed inside a cleaner main body to generate an air suction force, and separates and collects the foreign substance. The vacuum cleaner performing the above function is classified into a manual vacuum cleaner that is directly manipulated by a user and a robot cleaner that performs cleaning by itself without the user manipulation. A robot cleaner sucks various foreign substances lying on a face to be cleaned while autonomously travelling on the face-to-be cleaned.

Korean Patent Application Publication No. 10-2006-0111788 discloses a technology in which a robot cleaner includes a side brush to clean various faces of a floor during cleaning. According to the prior art, when the side brush hits an obstacle, the obstacle may move closer to a suction portion and may be sucked into the cleaner. However, in the prior art, when the obstacle does not move when the side brush hits the obstacle, the side brush may be caught by the obstacle and may be damaged, or a strong rotation force may be transmitted to the obstacle and the obstacle may be damaged. In particular, when the obstacle corresponds to an electric wire, the electric wire may be cut and a phenomenon such as an electric leakage and the like may occur.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
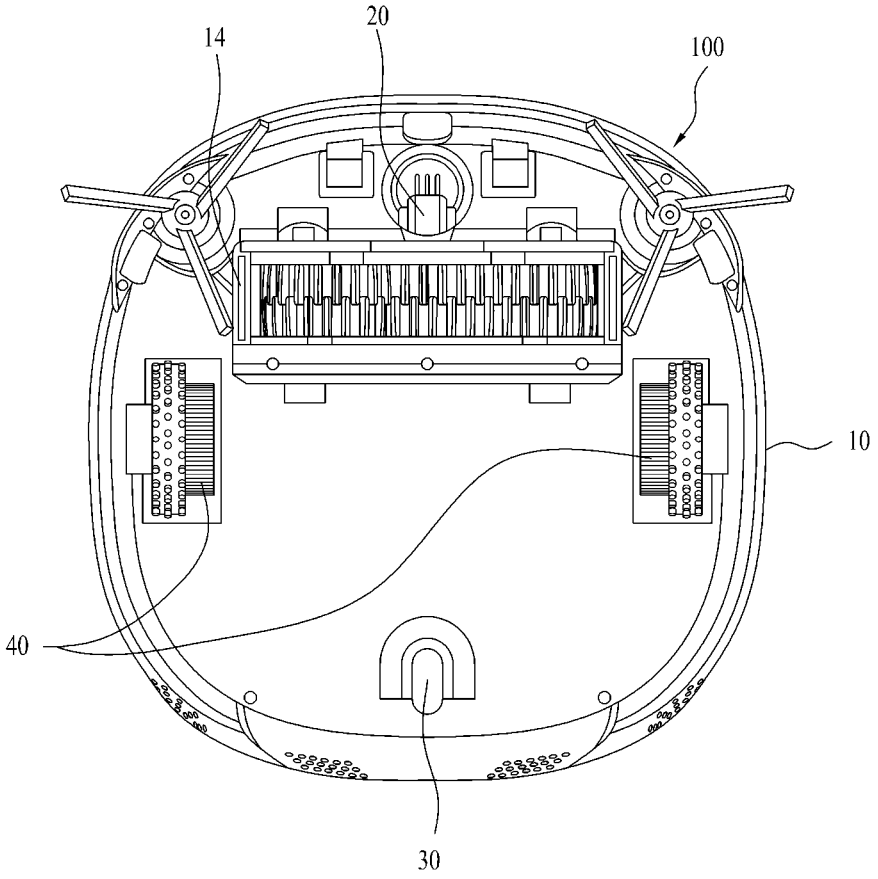
FIG. 1 is a view illustrating a bottom face of a robot cleaner according to the present disclosure.

Hereinafter, a preferred embodiment of the present disclosure that may specifically realize the above objects will be described with reference to the accompanying drawings. In this process, a size, a shape, or the like of a component shown in the drawings may be exaggerated for clarity and convenience of the description. In addition, terms specifically defined in consideration of a configuration and an operation of the present disclosure may vary depending on a user or an operator's intention or practice. Definitions of such terms should be made based on the contents throughout this specification.

FIG. 1 is a view illustrating a bottom face of a robot cleaner according to the present disclosure. Hereinafter, a description will be achieved with reference to FIG. 1. The present disclosure includes a main body 10 for forming an exterior, main wheels 40 arranged on the main body 10 and rotating such that the main body 10 may be moved back and forth or may turn, and a front auxiliary wheel 20 for supporting one side of the main body 10 and assisting the turning of the main body 10 by the main wheels 40. In this connection, the main wheels 40 are arranged on left and right sides of the main body 10 independently of each other. The main wheels 40 on the left and right sides may be driven independently of each other.

The main body 10 includes a suction portion (or suction port) 14 for sucking a foreign substance and the like. The suction portion 14 may include an agitator disposed on the main body 10 and being brought into contact with a floor face on which cleaning is performed while rotating, a suction hole defined in the main body 10 and capable of sucking the external foreign substance by a suction force generated inside the main body 10, and the like.

In one example, a rear auxiliary wheel 30 may be disposed rearward of the main wheels 40 to support the other side of the main body 10. The front auxiliary wheel 20 and the rear auxiliary wheel 30 are arranged to be freely rotatable in a horizontal direction with respect to the main body 10. In one example, the front auxiliary wheel 20 and the rear auxiliary wheel 30 are arranged to have a fixed height with respect to the main body 10.

In one example, although the main wheels 40 are not rotatable in the horizontal direction with respect to the main body 10, the main wheels 40 are composed of two wheels on both sides and the wheels on the both sides rotate at different rotational speeds or in different directions, so that the main body 10 may turn left or right. Especially, unlike the front auxiliary wheel 20, the main wheels 40 have a height varying with respect to the main body 10. The main wheels 40 may be moved to a desired location or rotated in a desired direction by a rotational force of the wheel in a state in which a rotation shaft is disposed substantially parallel to the floor face or a face to be cleaned where the robot cleaner is moved.

A side brush assembly 100 is disposed on one side of the main body 10. In the side brush assembly 100, as a brush rotates, the brush moves an obstacle located away from a bottom of the main body 10 or an obstacle in contact with a wall to be sucked into the suction portion 14. The side brush assembly 100 may be driven together with the suction portion 14 when the robot cleaner is driven.

In the side brush assembly 100, as a driving force for rotating the brush, a suction force generated in the suction portion 14 or a driving force for rotating the main wheels 40 may be used. In one example, the side brush assembly 100 may include a separate motor to generate a separate rotational force.

Figure 2:
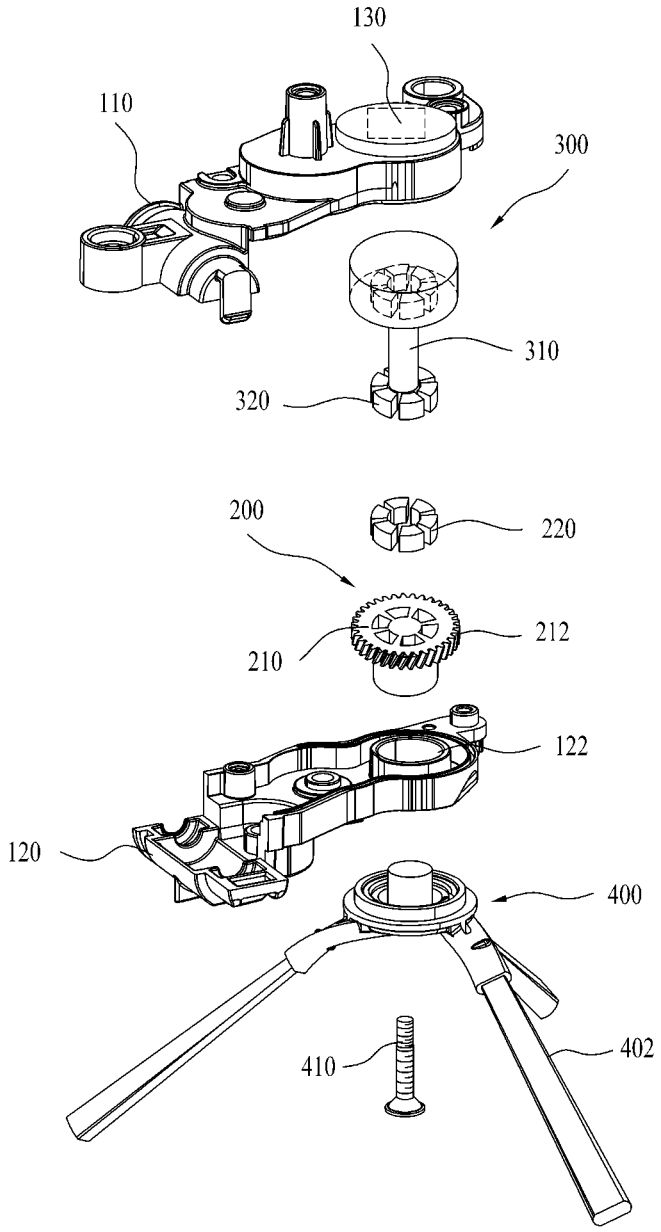
FIG. 2 is a view illustrating a side brush assembly according to an embodiment.
Figure 3:
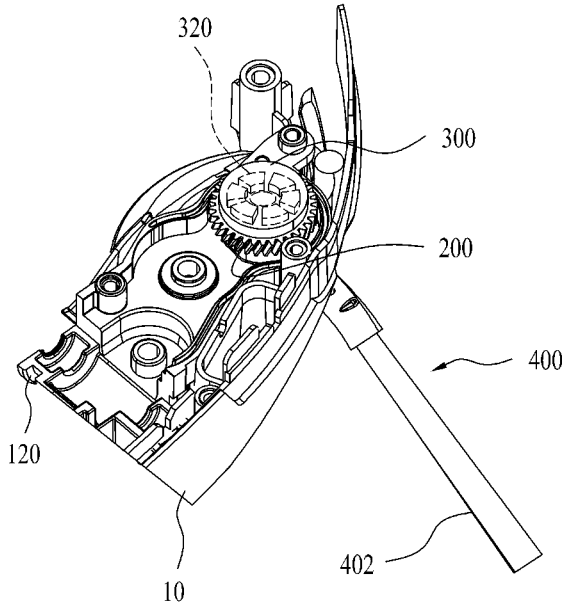
FIG. 3 is a view for illustrating main components in FIG. 2.
Figure 3:
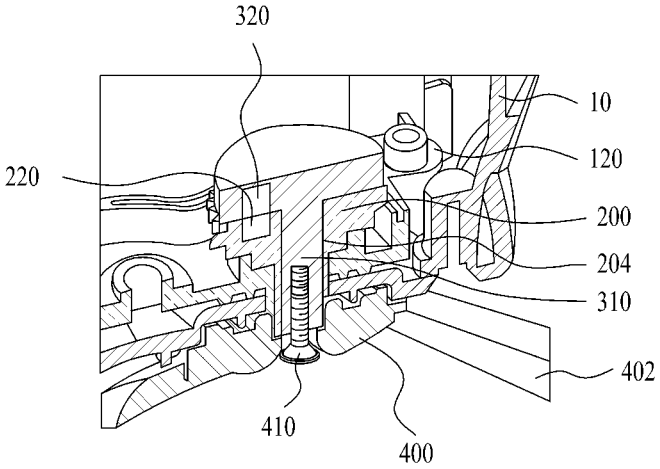

FIG. 2 is a view illustrating a side brush assembly according to an embodiment. Further, FIG. 3 is a view for illustrating main components in FIG. 2. Referring to FIGS. 2 and 3, the side brush assembly 100 includes a housing 110 and 120 forming an exterior of the side brush assembly 100, a first force transmitter (or gearing) 200 disposed in the housing 110 and 120 and rotated by receiving the driving force, a second force transmitter (or transfer case) 300 in contact with the first force transmitter to rotate together when the first force transmitter is rotated, and a side brush 400 coupled to the second force transmitter and rotated at the same rotation angle as the second force transmitter.

The housing includes a first housing 110 for finishing an upper exterior and a second housing 120 for finishing a lower exterior. A space in which a plurality of gears and various accessories may be accommodated is defined by the first housing 110 and the second housing 120. The side brush 400 is disposed to be exposed downward of the second housing 120, so that a portion of the side brush 400 may be exposed downward of the main body 10.

The first force transmitter 200 includes a gear 210 with teeth 212 formed thereon, and the driving force is transmitted to the first force transmitter 200 by gear engagement. That is, in the housing, in order to transmit the rotational force to the first force transmitter 200, another gear with teeth formed thereon is disposed, and the rotational force is transmitted to the gear 210 by such gear. In this connection, because the gears are engaged with each other by the teeth, the driving force may be transmitted to the first force transmitter 200 as it is. In a structure in which the rotation force is transmitted between the gears with the teeth, the teeth of both gears are engaged with each other, so that, when one of the gears is rotated, although the number of rotations of the other gear engaged with one gear varies based on a gear ratio, the other gear must be rotated. Thus, the first force transmitter 200 has a coupling structure to be necessarily rotated when an external driving force is transmitted to the first force transmitter 200.

The first force transmitter 200 includes a first magnet 220, and the second force transmitter 300 includes a second magnet 320 that applies an attractive force to the first magnet 220. The first force transmitter 200 and the second force transmitter 300 may be remained in a coupled state by the attractive force generated between the first magnet 220 and the second magnet 320. That is, when a factor affecting magnetic forces of the first magnet 220 and the second magnet 320 is not generated, the first force transmitter 200 and the second force transmitter 300 may be rotated together while maintaining the same rotation angle. That is, the rotational force of the first force transmitter 200 may be transmitted to the second force transmitter 300 by the magnetic force.

When the first force transmitter 200 receives the driving force, the first force transmitter 200 must be rotated when the gear rotates because the first force transmitter 200 is engaged with the teeth of the gear. On the other hand, because the first force transmitter 200 and the second force transmitter 300 are coupled with each other by the magnetic force, when a force that affects the magnetic force or is greater than the magnetic force is generated, the second force transmitter 300 may not be rotated even though the first force transmitter 200 is rotated. That is, the first force transmitter 200 and the second force transmitter 300 are coupled to each other such that the rotation angles may vary. Especially, when the side brush 410 hits an obstacle, a difference may occur between the rotation angle of the first force transmitter 200 and the rotation angle of the second force transmitter 300.

The side brush 400 includes a brush 402 that is rotated by the rotational force. The side brush 400 includes a plurality of, for example, three brushes 402. The brush 402 is able to hit an obstacle located on the floor face or a side face of the main body 10. The brush 402 is made of a material such as a bristle, so that the plurality of brushes are able to be tied together. In addition, the brush 402 is able to be made of a material that is deformed like rubber when a force having a magnitude equal to above a certain magnitude is applied, so that the obstacle hit by the brush 402 is not damaged.

The second force transmitter 300 may be disposed on a top face of the first force transmitter 200 and the side brush 400 may be disposed beneath the first force transmitter 200. That is, the second force transmitter 300 and the side brush 400 may be arranged vertically while having the first force transmitter 200 interposed therebetween.

In this connection, the second force transmitter 300 includes an extension 310 that penetrates the first force transmitter 200. A hollow through which the extension 310 may penetrate is defined at a center of the first force transmitter 200. The hollow is defined to have a cross-section larger or similar to a cross-section of the extension 310, so that the extension 310 may be easily rotated within the hollow. The hollow and the extension 310 have circular horizontal cross-sections, so that the extension 310 may be rotated within the hollow.

A through-hole 122 is defined in the second housing 120 such that the extension 310 penetrates the through-hole 122 and is coupled to the side brush 400. The through-hole 122 is defined to be penetrated by not only the extension 310 but also a protruding portion formed at a center of the transmitter 200.

The side brush 400 is coupled to the extension 310 by a screw 410. The screw 410 maintains screw engagement such that the side brush 400 is not removed from the second force transmitter 300. The extension 310 extends to an extent that the extension 310 is in contact with the side brush 400, so that the screw 410 mat not be in contact with the first force transmitter 200, and the side brush 400 and the second force transmitter 300 may be coupled to each other. The rotation angle or the number of rotations of the second force transmitter 300 is transmitted to the side brush 400 as it is, so that the side brush 400 is rotated in the same manner as the second force transmitter.

Because the driving force is transmitted to the first force transmitter 200 by the gear with the teeth formed thereon, the first force transmitter 200 must be rotated when there is the driving force. In addition, because the second force transmitter 300 is coupled to the side brush 400 by the screw 410, the side brush 400 must be rotated in the same manner when the second force transmitter 300 is rotated. However, because the first force transmitter 200 and the second force transmitter 300 are in the structure in which a force is transmitted by the magnetic force, the number or rotations or the rotation angles of the first force transmitter and the second force transmitter may vary temporarily or for a certain period of time by an external force. Thus, when the brush 402 hits the obstacle such as an electric wire, and when the obstacle such as the electric wire does not move, a rotation angle of the side brush 400 becomes different from the rotation angle of the first force transmitter 200 and the electric wire is not damaged, so that the robot cleaner may stably travel. Even when the driving force is continuously transmitted to the first force transmitter 200, the second force transmitter 300 does not need to rotate in the same manner as the first force transmitter 200, so that the side brush 400 may not rotate temporarily.

The first magnet 220 includes a plurality of magnets arranged to form a donut shape. The plurality of magnets of the first magnet 220 may be arranged to be separated from each other and may be widely arranged on a top face of the first force transmitter 200.

The second magnet 320 includes a plurality of magnets arranged to form a donut shape. The second magnet 320 may be disposed to face the first magnet such that the attractive force resulted from the magnetic force with the first magnet 220 is easily generated. The numbers of magnets of the first magnet 220 and the second magnet 320 are the same and areas of the first magnet 220 and the second magnet 320 facing each other are the same, so that the attractive force generated by the two magnets may be effectively maintained largely.

The first housing 110 may include a sensor 130 that senses the rotation of the second force transmitter 300. The sensor 130 may sense the number of rotations of the second force transmitter 300 to sense a change in the number of rotations of the side brush 400. That is, when the number of rotations of the side brush 400 decreases than before, it may be determined that the obstacle has been hit by the brush 402.

Figure 4:
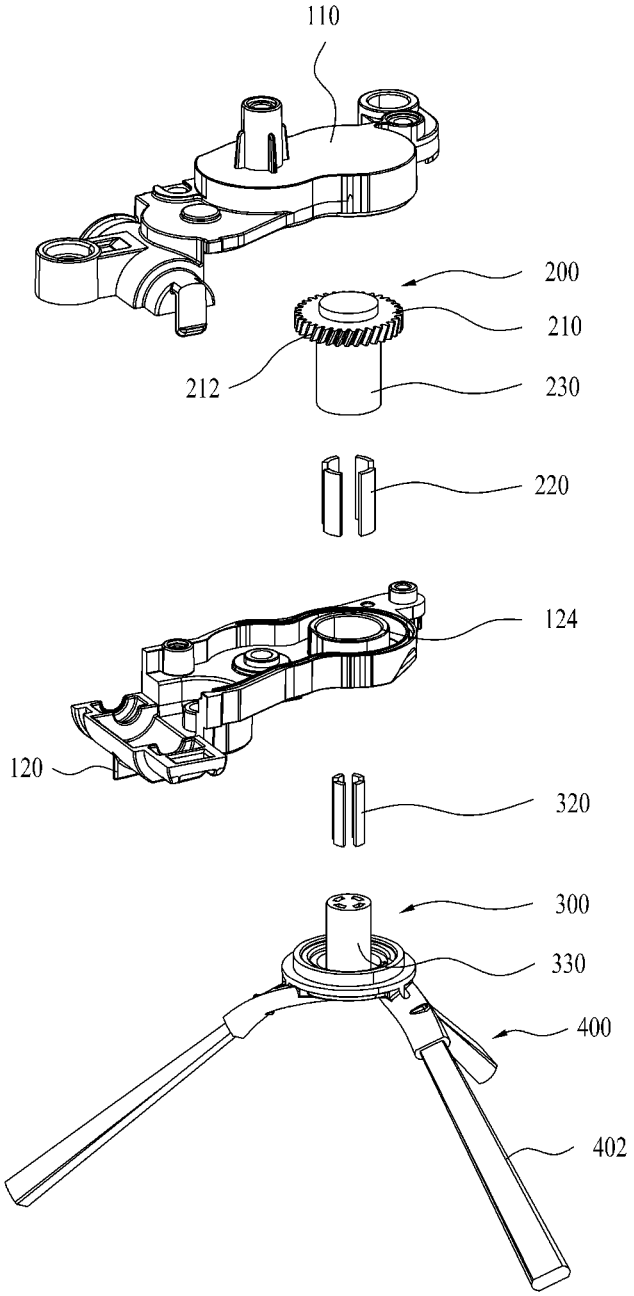
FIG. 4 is a view illustrating a side brush assembly according to another embodiment.

FIG. 4 is a view illustrating a side brush assembly according to another embodiment. In another embodiment of FIG. 4, the coupling relationship between the first force transmitter 200, the second force transmitter 300, and the side brush 400 is only partially different from and is substantially the same as that in the above described embodiment. Thus, a description of an overlapping portion will be omitted. It will be appreciated by those skilled in the art that the portions described in the above described embodiment may also be applied to the present embodiment.

The first force transmitter 200 is disposed on the top face of the second force transmitter 300. In addition, the second force transmitter 300 may be formed integrally with the side brush 400. Thus, the second force transmitter 300 and the side brush 400 are rotated together with the same rotation angle and the same number of rotations. The first force transmitter 200 has a first cylinder 230 having a hollow defined therein. The gear 210 is disposed at an upper portion of the first cylinder 230.

The second force transmitter 300 includes a second cylinder 330 that is inserted into the hollow of the first cylinder 230. It is preferable that the second cylinder 330 is formed to have a cross-section smaller than that of the hollow of the first cylinder 230 such that a rotation of the second cylinder 330 in the hollow of the first cylinder 230 different from a rotation of the first cylinder 230 in the number of rotations or a rotation angle is available. The first cylinder 230 and the second cylinder 330 are arranged to overlap each other in a height direction. Thus, when the first cylinder 230 and the second cylinder 330 are coupled to each other, an upper side of the second cylinder 330 is not exposed to the outside when viewed from the side.

The first magnet 220 is extended in the height direction perpendicular to a diameter of the first cylinder 230. The first magnet 220 may be disposed on an inner face of the first cylinder 230 facing the second cylinder 330 and the second magnet 320 may be disposed on an outer face of the second cylinder 330 to face the first magnet. Because an overlapping portion of the first cylinder 230 and the second cylinder 330 is large in the height direction, the magnets are arranged in the height direction of the cylinders such that the attractive force between the two magnets increases.

The plurality of magnets of the first magnet 220 and the plurality of magnets of the second magnet 320 are respectively arranged on side faces of the cylinders to face each other. The first magnet 220 is disposed to surround an outer circumferential face of the second magnet 320. This is because, when the cylinders are viewed from above, a line connecting the plurality of magnets of the first magnet 220 with each other exists outward of a line connecting the plurality of magnets of the second magnet 320 with each other. Because a shape of a circle by the plurality of magnets of the first magnet is larger than a shape of a circle by the plurality of magnets of the second magnet, the first magnet and the second magnet are extended along the height direction of the cylinders, so that the areas of the first magnet and the second magnet facing each other increase, thereby increasing the magnetic force.

In one example, the second housing 120 may have a cylinder-shaped through-hole 124 defined therein into which the second cylinder 330 of the second force transmitter 300 is inserted. Because the first force transmitter 200 and the second force transmitter 300 may be coupled to each other by the magnetic forces between the magnets, a structure for fixing the second cylinder 330 into the through-hole 124 doesn't need to be disposed. Because the magnets are extended in the height direction of the cylinders, even when the magnetic force decreases as the areas of the magnets facing each other are instantaneously reduced, the second force transmitter 300 may not be dropped in a downward direction of the first force transmitter 200. Thus, the second force transmitter 300 may be prevented from being removed from the housing. In this connection, the two magnets are respectively placed at locations having different radii with respect to the centers of the two cylinders, which may create the attractive force between the magnets.

Figure 5:
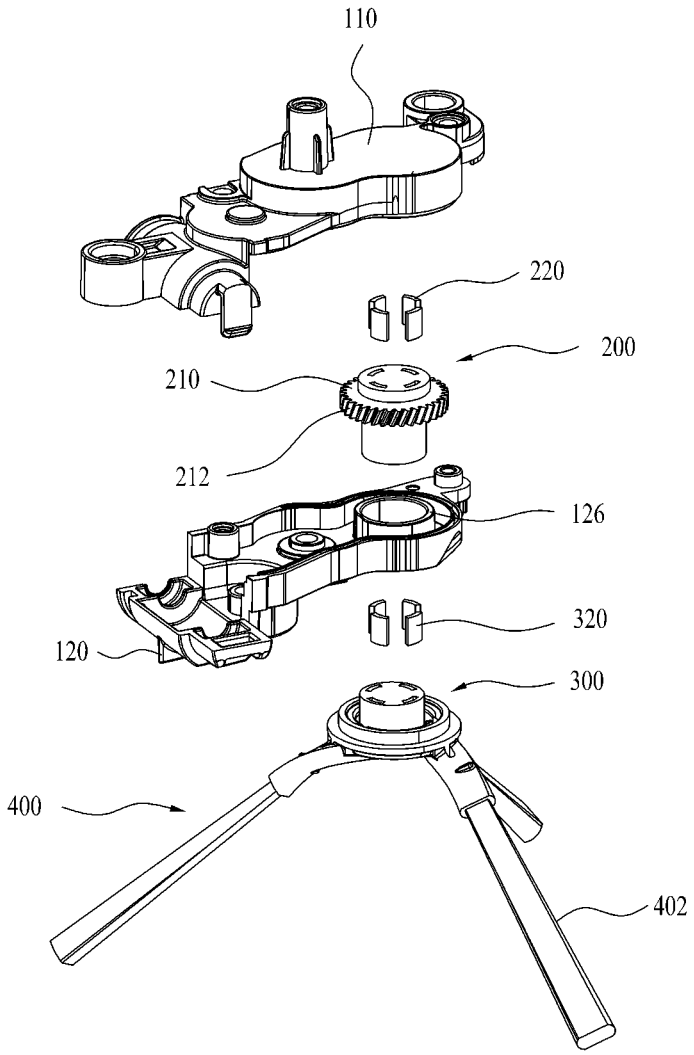
FIG. 5 is a view illustrating a side brush assembly according to another embodiment.

FIG. 5 is a view illustrating a side brush assembly according to another embodiment. In another embodiment of FIG. 5, the coupling relationship between the first force transmitter 200, the second force transmitter 300, and the side brush 400 is only partially different from and is substantially the same as that in the above described embodiment. Thus, a description of an overlapping portion will be omitted. It will be appreciated by those skilled in the art that the portions described in the above described embodiment may also be applied to the present embodiment.

In particular, in the embodiment of FIG. 5, unlike the embodiment of FIG. 4, the magnets are arranged on a bottom face and a top face of the cylinders and are coupled to each other. On the other hand, in FIG. 4, the magnets are respectively arranged on the inner face and the outer face of the cylinders to be coupled to each other. In the embodiment of FIG. 5, unlike the embodiment of FIG. 4, the magnets are arranged on total cross-sections and the attractive force generated between the magnets is used.

The first magnet 220 includes the plurality of magnets and is disposed beneath the transmitter 200. The second magnet 320 includes the plurality of magnets and is disposed on the top face of the second force transmitter 300 to face the first magnet.

The first magnet 220 is disposed at an upper position and the second magnet 320 is disposed below the first magnet 220, so that the two magnets are arranged at different heights from each other. The attractive force is generated between the magnets with the different heights, so that the rotational force of the first force transmitter 200 may be transmitted to the second force transmitter 300.

A through-hole 126 is defined in the second housing 120 to allow the second force transmitter 300 to pass therethrough. The through-hole 126 has a cylindrical shape in the same manner as the second force transmitter 300, but has a cross-section larger than that of the force transmitter 300, thereby providing a structure in which the second force transmitter 300 is able to freely rotate in a state of penetrating the through-hole 126.

Figure 6:
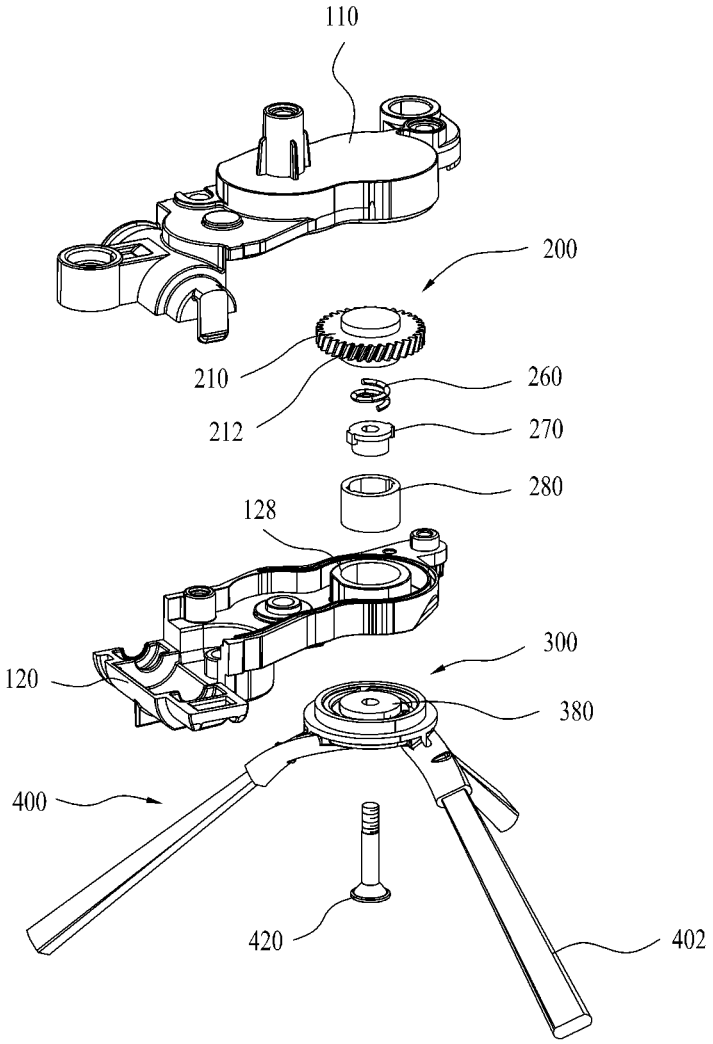
FIG. 6 is a view illustrating a side brush assembly according to another embodiment.

FIG. 6 is a view illustrating a side brush assembly according to another embodiment. In another embodiment of FIG. 6, the coupling relationship between the first force transmitter 200, the second force transmitter 300, and the side brush 400 is only partially different from and is substantially the same as that in the above described embodiment. Thus, a description of an overlapping portion will be omitted. It will be appreciated by those skilled in the art that the portions described in the above described embodiment may also be applied to the present embodiment.

In the present embodiment, the first force transmitter 200 may transmit the rotational force to the second force transmitter 300 by a frictional force. In the above-described embodiment, the rotational force of the first force transmitter is transmitted to the second force transmitter by the magnetic force.

The first force transmitter 200 includes a spring 260 and a friction portion pressed by the spring 260. The friction portion may include a friction plate 270 disposed beneath the spring 260 and a friction plate fixing frame 280 for fixing the friction plate 270 at a bottom face thereof. The second force transmitter 300 is formed with a friction face 380 that is rubbed by the friction portion.

The spring 260 is pressed downward by a bottom face of the gear 210. Thus, the spring 260 exerts a force downward by a restoring force. The spring 260 may be a compression spring that applies a force in a tensile direction to have an original size thereof again when compressed.

The friction plate 270 is fixed to the bottom face of the friction plate fixing frame 280, and the friction plate 270 is continuously pressed downward by the spring 260. The friction face 380 is disposed below the friction plate 270, and friction is generated between the friction plate 270 and the friction face 380. In this connection, a bottom face of the friction plate 270 and a top face of the friction face 380 may be made of materials having a great coefficient of friction such that the friction is generated therebetween.

In one example, the second force transmitter 300 and the side brush 400 are integrally formed, so that the second force transmitter 300 and the side brush 400 may be rotated together. The present embodiment includes a coupling portion (or fastener) 420 in which a thread is formed in some regions and the thread is not formed in other regions. A flange having a cross-section larger than that of the region where the thread is formed is formed at the other end of the coupling portion 420 such that the side brush 400 does not be separated. The second force transmitter 300 is coupled to the first force transmitter 200 by the coupling portion 420.

The thread is formed at a portion of the coupling portion 420 coupled to the first force transmitter 200. Thus, even when the first force transmitter 200 is rotated, the coupling portion 420 may be maintained in the state of being coupled to the first force transmitter 200 without being separated from the first force transmitter 200. The thread is not formed at a portion of the coupling portion 420 coupled to the second force transmitter 300, so that the second force transmitter is rotatable relative to the coupling portion. That is, based on FIG. 6, the first force transmitter 200 is coupled to an upper portion of the coupling portion 420, and the second force transmitter 300 and the side brush 400 are coupled to a lower portion of the coupling portion 420. The second force transmitter 300 and the side brush 400 are not separated from the coupling portion 420 by the flange disposed at the lower portion of the coupling portion 420.

The friction may occur while the friction plate 270 is pressed by the spring 260 to be in contact with the friction face 380. Thus, the rotational force of the first force transmitter 200 may be transmitted to the second force transmitter 300.

In the above-described embodiment, the first force transmitter 200 is coupled by the member that receives the external driving force and the gear with the teeth. Thus, when the driving force is constantly generated, the first force transmitter must be constantly rotated. However, when the brush 402 encounters the obstacle, especially an obstacle that does not move, such as the electric wire, the brush 402 may not be rotated and an excessive rotational force may be applied to the side brush 400. In the present embodiment, even when the first force transmitter is rotated and the second force transmitter is not rotated temporarily or for the certain period of time, the coupling between the second force transmitter and the first force transmitter is maintained such that the second force transmitter and the side brush are not damaged. That is, when the brush hits the obstacle, the difference in the rotation angles or the number of rotations of the first force transmitter and the second force transmitter may be induced, thereby preventing excessive force on the second force transmitter and the side brush.

Figure 7:
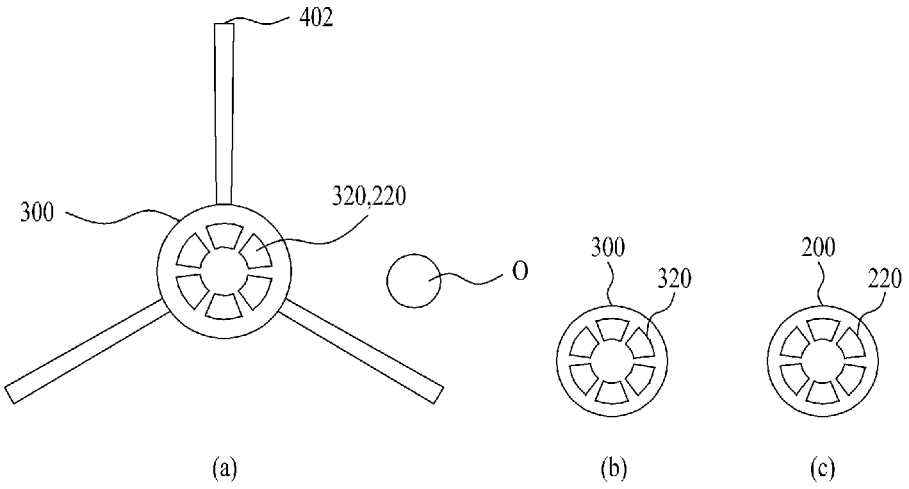
FIGS. 7 and 8 illustrate operations according to an embodiment.
Figure 8:
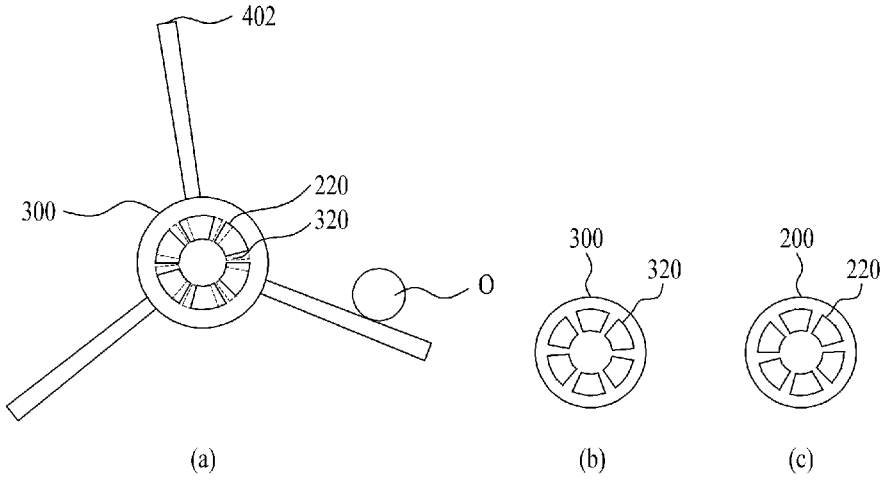

FIG. 7 illustrates an operation according to an embodiment. FIG. 7 illustrates a state before the brush 402 encounters an obstacle, and FIG. 8 illustrates a state in which the brush 402 encounters the obstacle. Region (a) in FIG. 7 is a conceptual diagram of a situation before encountering the obstacle, region (b) in FIG. 7 is a view illustrating a location of the second magnet, and region (c) in FIG. 7 is a view illustrating a location of the first magnet. As shown in FIG. 7, before the brush 402 encounters an obstacle O, the first magnet 220 and the second magnet 320 rotate together in a state of being in contact with each other while maintaining initial locations thereof by the attractive force generated therebetween. That is, the first magnet 220, the second magnet 320, and the brush 402 rotate together at the same rotation speed and the same rotation angle. That is, as shown in regions (b) and (c) in FIG. 7, the first magnet 220 and the second magnet 320 rotate at the same rotation angle.

Region (a) in FIG. 8 is a conceptual diagram of a situation in which the obstacle is encountered, region (b) in FIG. 8 is a view illustrating a location of the second magnet, and region (c) in FIG. 8 is a view illustrating a location of the first magnet. As shown in FIG. 8, when the brush 402 encounters the obstacle, the rotation angles and rotation speeds of the first magnet 220 and the second magnet 320 are changed as the first magnet 220 and the second magnet 320 become misaligned each other. As shown in regions (b) and (c) in FIG. 8, the rotation angles of the first magnet and the second magnet become different from each other, so that all faces of the magnets of the first magnet and all faces of the magnets of the second magnet are not in contact with each other and arranged in a misaligned state. Specifically, the first magnet 220 is rotated at a constant rotation speed by receiving the driving force. On the other hand, the rotation of the second magnet 320 is delayed because of the obstacle O. Thus, the first magnet 220 may have an angle rotated more counterclockwise than the second magnet 320. Thus, the first magnet 220 may have a rotation angle greater than that of the second magnet 320 in a counterclockwise direction.

In one example, when the brush 402 is deviated from the obstacle O and does not in contact with the obstacle O, the rotation angles of the first magnet 220 and the second magnet 320 may become equal to each other again as shown in FIG. 7. FIGS. 7 and 8 are identically applied to all the above-described embodiments.

The present disclosure is to provide a robot cleaner with improved stability during travel. In addition, the present disclosure is to provide a robot cleaner in which a rotation of a side brush changes when an obstacle is caught on the side brush, thereby preventing damage of the obstacle or the side brush.

In order to achieve the above aspects, the present disclosure includes a main body including a suction portion disposed thereon, main wheels for moving the main body, and a side brush assembly disposed on the main body and rotating with a rotation shaft perpendicular to a rotation shaft of the main wheels, wherein the rotation of the side brush assembly may change based on whether an obstacle is hit.

The side brush assembly may include a housing for forming an exterior of the side brush assembly, a first force transmitter disposed in the housing and rotating by receiving a driving force, a second force transmitter in contact with the first force transmitter to rotate together when the first force transmitter is rotated, and a side brush coupled to the second force transmitter to rotate at the same rotation angle as the second force transmitter. Rotation schemes of the first force transmitter and the second force transmitter may be changed in a situation in which the side brush hits the obstacle.

The robot cleaner characterized in that the first force transmitter and the second force transmitter are coupled to each other such that rotation angles of the first force transmitter and the second force transmitter are able to vary, and a difference between the rotation angle of the first force transmitter and the rotation angle of the second force transmitter occurs when the obstacle is hit by the side brush. The first force transmitter includes a gear with teeth formed thereon and the driving force is transmitted to the first force transmitter by gear engagement, so that the first force transmitter constantly rotates when the driving force is constant. When the driving force is continuously provided, the first force transmitter is also continuously rotated.

The first force transmitter includes a first magnet, wherein the second force transmitter includes a second magnet for exerting an attractive force on the first magnet, and wherein a rotational force of the first force transmitter is able to be transmitted to the second force transmitter by a magnetic force. The first force transmitter may transmit a rotational force to the second force transmitter by a frictional force. In this connection, the first force transmitter may include a spring, and a friction portion pressed by the spring, wherein a friction face rubbed by the friction portion may be formed on the second force transmitter.

According to the present disclosure, even when the side brush hits an obstacle that is not moved by the side brush, no damage occurs to the side brush or the obstacle, so that the robot cleaner may travel stably. That is, according to the present disclosure, when a rotational force having a magnitude equal to or greater than a certain magnitude is applied to the side brush, the rotational force of the side brush may be changed such that the side brush no longer hits the obstacle.

In certain examples, a cleaner comprises a main body including a suction port; and a brush assembly provided on the main body, wherein the brush assembly includes: a housing for forming an exterior of the brush assembly; a gearing provided in the housing and configured to rotate based on receiving a driving force; a transfer case configured to be selectively coupled to the gearing and to rotate when coupled to the gearing and the gearing is rotated; and a brush coupled to the transfer case and configured to rotate with the transfer case along a rotational axis that extends in vertical direction.

A difference between a rotation angle of the gearing and a rotation angle of the transfer case occurs when the brush contacts an obstacle. The gearing includes a gear with teeth formed thereon and the driving force is transmitted to the gearing based on engagement with the teeth of the gear.

At least one of the gearing or the transfer case may include a magnet, and a rotational force of the gearing is transmitted to the transfer case by a magnetic force. The transfer case may be provided on a top face of the gearing, and the brush may be provided beneath the gearing. The transfer case may include an extension formed thereon to penetrate the gearing, and the brush may be coupled to the extension.

The gearing may include a plurality of first magnets arranged to form a donut shape, the transfer case may include a plurality of second magnets provided to face the first magnets. A quantity of the first magnets corresponds to a quantity of the second magnets, and an area of surfaces of the first magnets facing the second magnets corresponds to an area of surfaces of the second magnets facing the first magnetics.

The gearing includes a first cylinder with a hollow defined therein, and the transfer case includes a second cylinder inserted into the hollow of the first cylinder. The gearing includes a first magnet that extends on an inner face of the first cylinder facing the second cylinder in a height direction perpendicular to a diameter of the first cylinder, and the transfer case includes a second magnet is that provided on an outer face of the second cylinder to face the first magnet.

The first magnet may be provided to surround an outer circumferential face of the second magnet. A cylinder-shaped through-hole may be defined in the housing, and the second cylinder of the transfer case may be inserted into the through-hole. The gearing may include a plurality of first magnets, and the transfer case may include a plurality of second magnets that are provided below the first magnets.

The gearing may transmit a rotational force to the transfer case by a friction force. The gearing may include a spring; and a friction plate pressed by the spring, wherein a friction face configured to be rubbed by a surface of the friction plate is formed on the transfer case. The friction plate may be provided beneath the spring, and the gearing may include a frame that fixes the friction plate on a bottom face thereof.

The cleaner may further comprise a fastener that couples the gearing and the transfer case, wherein the fastener includes a first section that has a thread formed thereon and is configured to be coupled to the gearing, and a second section that extends through an opening in the transfer case and does not include a thread so that the transfer case is rotatably provided with respect to the second section of the fastener.

The cleaner may further comprise at least one main wheel that rotates based on receiving a driving force to move the main body, wherein a rotational axis of the brush is perpendicular to a rotational axis of the main wheel.

In another example, a cleaner comprises: a main body; a first coupling configured to rotate based on receiving a driving force; a second coupling, wherein a connection force is provided between first coupling and the second coupling; and a brush coupled to the second coupling and configured to rotate with the second coupling along a rotational axis that extends in vertical direction, wherein: when the brush does not contact an obstacle, the second coupling transmits a rotation of the first coupling to the brush, and when the brush contacts the obstacle, the second coupling is uncoupled from the first coupling such that the second coupling and the brush stop rotating while the first coupling continues to rotate. The coupling force between the first coupling and the second coupling may include at least one of friction or a magnetic force.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a main body including a suction port; and a brush assembly provided on the main body, wherein the brush assembly includes:

a housing for forming an exterior of the brush assembly;

a gearing provided in the housing and configured to rotate based on receiving a driving force;

a transfer case configured to be selectively coupled to the gearing and to rotate when coupled to the gearing and the gearing is rotated; and a brush coupled to the transfer case and configured to rotate with the transfer case along a rotational axis that extends in a vertical direction.

2. The cleaner of claim 1, wherein a difference between a rotation angle of the gearing and a rotation angle of the transfer case occurs when the brush contacts an obstacle.

3. The cleaner of claim 1, wherein the gearing includes a gear with teeth formed thereon and the driving force is transmitted to the gearing based on engagement with the teeth of the gear.

4. The cleaner of claim 1, wherein at least one of the gearing or the transfer case includes a magnet, and wherein a rotational force of the gearing is transmitted to the transfer case by a magnetic force.

5. The cleaner of claim 4, wherein the transfer case is provided on a top face of the gearing, and wherein the brush is provided beneath the gearing.

6. The cleaner of claim 5, wherein the transfer case includes an extension formed thereon to penetrate the gearing, and wherein the brush is coupled to the extension.

7. The cleaner of claim 4, wherein the gearing includes a plurality of first magnets positioned to form a donut shape, and wherein the transfer case includes a plurality of second magnets provided to face the first magnets.

8. The cleaner of claim 7, wherein a quantity of the first magnets corresponds to a quantity of the second magnets, and an area of surfaces of the first magnets facing the second magnets corresponds to an area of surfaces of the second magnets facing the first magnets.

9. The cleaner of claim 4, wherein the gearing includes a first cylinder with a hollow defined therein, and wherein the transfer case includes a second cylinder inserted into the hollow of the first cylinder.

10. The cleaner of claim 9, wherein the gearing includes a first magnet that extends on an inner face of the first cylinder facing the second cylinder in a height direction perpendicular to a diameter of the first cylinder, and wherein the transfer case includes a second magnet is that provided on an outer face of the second cylinder to face the first magnet.

11. The cleaner of claim 10, wherein the first magnet is provided to surround an outer circumferential face of the second magnet.

12. The cleaner of claim 9, wherein a cylinder-shaped through-hole is defined in the housing, and wherein the second cylinder of the transfer case is inserted into the through-hole.

13. The cleaner of claim 4, wherein the gearing includes a plurality of first magnets, and wherein the transfer case includes a plurality of second magnets that are provided below the first magnets.

14. The cleaner of claim 1, wherein the gearing transmits a rotational force to the transfer case by a friction force.

15. The cleaner of claim 14, wherein the gearing includes:

a spring; and a friction plate pressed by the spring, and wherein a friction face configured to be rubbed by a surface of the friction plate is formed on the transfer case.

16. The cleaner of claim 15, wherein the friction plate is provided beneath the spring, and the gearing includes a frame that fixes the friction plate on a bottom face thereof.

17. The cleaner of claim 16, further comprising a fastener that couples the gearing and the transfer case, wherein the fastener includes a first section that has a thread formed thereon and is configured to be coupled to the gearing, and a second section that extends through an opening in the transfer case and does not include a thread so that the transfer case is rotatably provided with respect to the second section of the fastener.

18. The cleaner of claim 1, further comprising at least one main wheel that rotates based on receiving a driving force to move the main body, wherein the rotational axis of the brush is perpendicular to a rotational axis of the main wheel.

19. A cleaner comprising:

a main body;

a first coupling configured to rotate based on a received driving force;

a second coupling, wherein a connection force is provided between the first coupling and the second coupling; and a brush coupled to the second coupling and configured to rotate with the second coupling along a rotational axis that extends in vertical direction, wherein:

when the brush does not contact an obstacle, the second coupling transmits a rotation of the first coupling to the brush, and when the brush contacts the obstacle, the second coupling is uncoupled from the first coupling such that the second coupling and the brush stop rotating while the first coupling continues to rotate.

20. The cleaner of claim 19, wherein the connection force between the first coupling and the second coupling includes at least one of friction or a magnetic force.

* * * * *